US007527554B2

(12) United States Patent
Schmid

(10) Patent No.: US 7,527,554 B2
(45) Date of Patent: May 5, 2009

(54) ROLLABLE ROOF RIDGE AND VENTILATION ELEMENT

(75) Inventor: Oliver Schmid, Gingen a.d. Fils (DE)

(73) Assignee: Schmid Baukunststoffe GmbH, Gingen a.d. Fils (DE)

( * ) Notice: Subject to any disclaimer, the term of this patent is extended or adjusted under 35 U.S.C. 154(b) by 0 days.

(21) Appl. No.: 11/783,735

(22) Filed: Apr. 11, 2007

(65) Prior Publication Data

US 2007/0251162 A1 Nov. 1, 2007
US 2009/0064600 A9 Mar. 12, 2009

Related U.S. Application Data

(63) Continuation of application No. PCT/EP2004/011355, filed on Oct. 11, 2004.

(51) Int. Cl.
*F24F 7/02* (2006.01)
*E04B 7/00* (2006.01)

(52) U.S. Cl. ..... 454/365; 52/198; 52/199

(58) Field of Classification Search ..... 454/364, 454/365, 366; 52/198, 199
See application file for complete search history.

(56) References Cited

U.S. PATENT DOCUMENTS 4,907,499 A * 3/1990 James ..... 454/365
5,002,616 A * 3/1991 Hofmann et al. ..... 428/138
5,579,615 A * 12/1996 Hoffman ..... 52/202
5,738,581 A * 4/1998 Rickert et al. ..... 454/365
5,740,634 A * 4/1998 Schade ..... 52/43
6,260,315 B1 * 7/2001 Smith ..... 52/199
6,361,434 B1 * 3/2002 Brandon ..... 454/365

FOREIGN PATENT DOCUMENTS

| | | | |
|---|---|---|---|
| DE | 196 04 256 | A1 | 8/1997 |
| DE | 197 34 379 | A1 | 2/1999 |
| DE | 297 23 782 | U1 | 2/1999 |
| DE | 198 21 035 | A1 | 11/1999 |
| DE | 298 80 057 | U1 | 7/2000 |
| DE | 200 08 149 | U1 | 8/2000 |
| DE | 100 21 937 | A1 | 11/2001 |
| EP | 0 911 459 | A | 4/1999 |
| WO | WO 9637669 | A1 * | 11/1996 |

OTHER PUBLICATIONS

International Search Report dated May 20, 2005 issued in PCT/EP2004/011355 with Written Office Action, Form PCT/ISA/237 with English translation.

* cited by examiner

*Primary Examiner*—Steven B McAllister
*Assistant Examiner*—Patrick F. O'Reilly, III
(74) *Attorney, Agent, or Firm*—Venable LLP; Robert Kinberg; Ryan M. Flandro

(57) ABSTRACT

A rollable roof ridge ventilation element for slanted roofs comprises a ribbon-type, air-permeable carrier material. Edge strips of an elastically deformable film are connected to edge regions of the carrier material. Each edge strip includes an upward-pointing fold in a longitudinal direction of the ventilation element presenting a wind-repelling lip. Each edge strip has transverse undulations, and the wind-repelling lip of an edge strip includes undulations that extend transverse to a longitudinal direction of the wind-repelling lip and correspond to the transverse undulations of the edge strip.

4 Claims, 1 Drawing Sheet

ROLLABLE ROOF RIDGE AND VENTILATION ELEMENT

CROSS-REFERENCE TO RELATED APPLICATION

This application is a continuation application of PCT International Patent Application No. PCT/EP2004/011355, filed Oct. 11, 2004, designating the United States, the disclosure of which is incorporated herein by reference.

BACKGROUND

The invention relates to a rollable roof ridge ventilation element for slanted roofs, consisting of a strip-type, air-permeable carrier material that is connected to edge strips of an elastically deformable plastic film. A roof ridge ventilation element of this type is already known from German patent document DE 198 21 035 B4.

Roof ridge ventilation elements are commercially available and are used for the air-permeable sealing of ridge and hip stones on building roofs. These ventilation elements consist of an air-permeable strip-type carrier material that is provided with self-adhesive tapes along its edges. The strip-type carrier material is installed longitudinally in the center of the ridge or hip pole and is attached with the aid of its self-adhesive tapes to the adjacent roof tiles. Since roof tiles for the most part do not have a flat surface, but a curved (pan-shaped) surface, the strip-type carrier material is either pleated across the total width, in the manner of a bellows, or only the edge regions that must be glued on are pleated or cut to form a fringe. Following this, the ridge or hip stones are fitted over the completely installed ventilation element and are held in place by means of brackets.

Commercially available roof ridge ventilation elements have different structural features to ensure a sufficient flow of air from the roof inside area through the strip-type carrier material and into the transverse channel, through which outside air flows and which is located between the ridge or hip stone and the top of the roofing mat. The simplest variant of a carrier material consists of a foam-material strip, having a thickness of approximately 13 mm and an air-permeability of up to 99 percent. The center region and the edge regions of the foam strip are thermally compressed to a thickness of approximately 1 mm, wherein the center region remains flat and the edge regions are profiled so as to be undulating. Owing to its extremely low weight and simultaneously large surface area, the known foam material roof ridge ventilation element is always in danger of being carried off by wind during the installation.

According to a second variant, the strip-type carrier material consists of an extremely thin and light-weight, needle-perforated plastic non-woven with low rigidity, which is provided along both edge regions with metal strips of aluminum foil, installed on the top, and is provided in the center region, on the underside, with a stiffer and thicker reinforcements strip of plastic non-woven material. Following the gluing on of the metal strip and the reinforcement strip, profile rollers are used to pleat the strip-type carrier material over its complete width. In addition, holes are punched into both superimposed non-woven materials in the center region during the profile rolling, wherein these holes are spaced apart in longitudinal direction of the strip by approximately half the pitch height for the pleating.

A third variant for a roof ridge ventilation element, disclosed in German patent document DE 196 04 256 A1, is based on the idea that a strip of perforated synthetic or rubber is best suited for an air-permeable sealing. The high density and thus the high specific weight of a rubber strip provides excellent preconditions for installing such a strip-type material on the roof, even if strong winds are present, without the danger of the wind carrying off the ventilation element. However, the difficulty with using a rubber strip is that it cannot be pleated permanently by means of profile rolling because of its elastic properties, but always has a tendency to return to its smooth, flat shape. To counter this problem and permanently pleat a strip of rubber, first the edge regions and then the center region of the smooth, flat strip of rubber for a known roof ridge ventilation element are covered with a thin metal strip, for example an aluminum foil, which can be deformed permanently with little force expenditure. Following this, only the metal strips and the thereto adhering regions of the rubber strip are pleated with the aid of profile rollers. The strength of the metal strips is selected such that the elastic forces of the pleated strip of rubber are not sufficient to restore the pleated metal strips to the original shape, meaning to smooth them out again.

German patent document DE 198 21 035 discloses a different rollable roof ridge ventilation element, for which the edge strips are embodied of a self-adhesive, elastically deformable rubber material and are glued onto the strip-type carrier material that is positioned in-between. The edge strips are covered on the top with a thin layer of an elastically deformable plastic film, designed to protect the edge strips against destructive UV radiation.

However, it has been found that with all known, rollable roof ridge ventilation elements, drizzle or flying snow can enter the roof inside area by way of the ventilation element if wind conditions are unfavorable.

SUMMARY

In contrast thereto, it is an object of the present invention to create a rollable roof ridge ventilation element, which securely prevents drizzle or flying snow from entering the roof inside area.

The above and other objects are accomplished according to the invention by the provision of a rollable roof ridge ventilation element for slanted roofs, which in one embodiment comprises: a ribbon-type, air-permeable carrier material, including edge regions; and edge strips of an elastically deformable film connected, respectively, to the edge regions of the carrier material, each edge strip including: an upward-pointing fold in a longitudinal direction of the ventilation element presenting a wind-repelling lip, wherein each edge strip is comprised of one of (a) a soft metal strip including at least one of aluminum, copper, or lead, or (b) a plastic film including a metallization on an exposed surface, and wherein each edge strip includes transverse undulations and the wind-repelling lip of each edge strip includes undulations that extend transverse to a longitudinal direction of the wind-repelling lip and correspond to the transverse undulations of the edge strip.

BRIEF DESCRIPTION OF THE DRAWING

The invention is explained in further detail in the following, considered in conjunction with the accompanying drawing.

DETAILED DESCRIPTION

Figure 1:
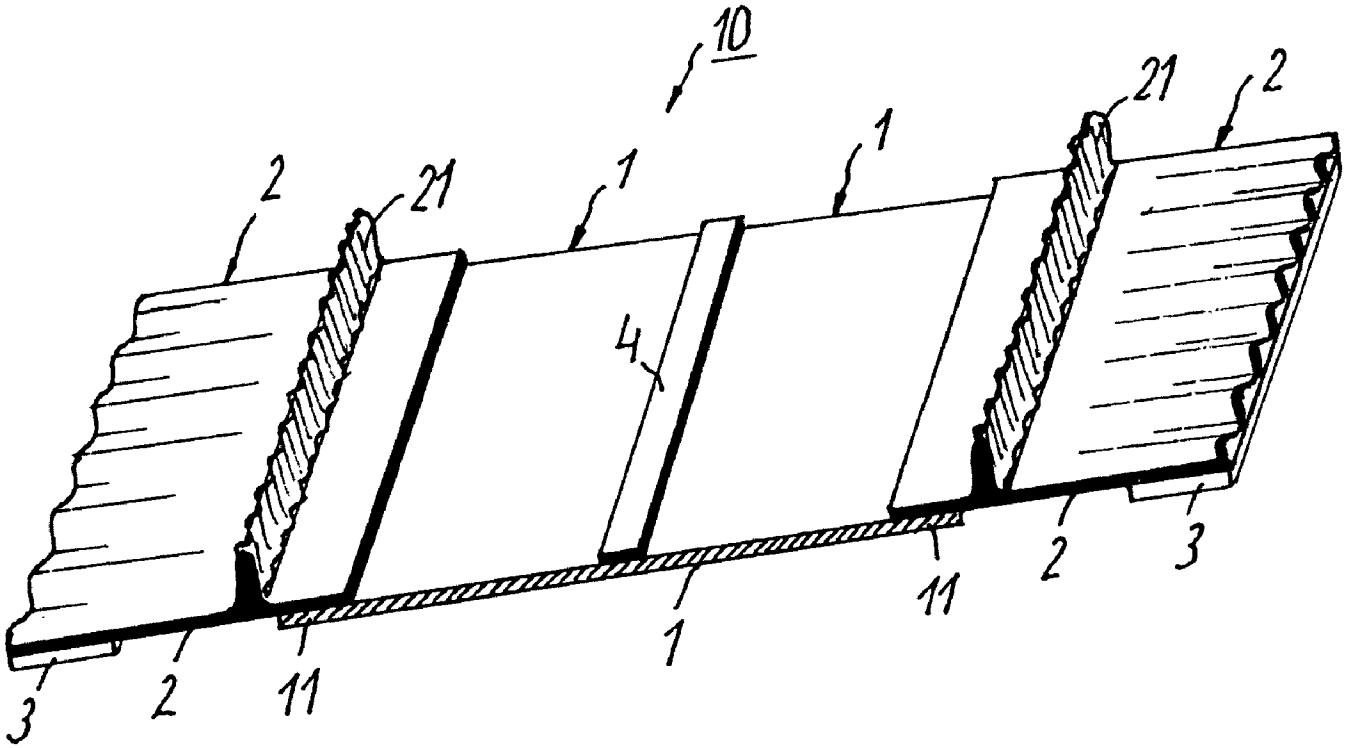
FIG. 1 shows a perspective view of a longitudinal section of the rollable roof ridge ventilation element according to the invention.

The roof ridge ventilation element 10, shown in FIG. 1, comprises a strip-type, air-permeable carrier material 1, for example a rolled up strip of perforated rubber, a fabric strip that is saturated or coated with rubber, an air-permeable non-woven material, a perforated air-permeable plastic film, or an air-permeable plastic fabric (e.g. of the type used for potato sacks). The carrier material 1 thickness preferably ranges from 0.2 mm to 2.0 mm. If a carrier material is used, which is not air-permeable per se or only slightly air-permeable, the complete material surface is preferably needle-perforated or provided with punched holes (for example with a hole diameter ranging from 2 mm to 5 mm), so as to ensure good air-permeability. The strip-type carrier material 1 width, for example, is 30 cm.

The strip-type carrier material 1 is preferably provided in its edge regions 11 with respectively on relatively wide edge strip 2 of an elastically deformable film, which may be glued to it. Each edge strip 2 has a width of 8 cm, for example, wherein its thickness (strength) may be in the range of approx. 0.7 mm. Each edge strip 2 is provided on its underside, along the outer edge region, with a self-adhesive strip 3 that is protected by a peel-off film, which is not shown herein. A soft metal strip of aluminum, copper, lead or the like can be considered, for example, as material for the elastically deformable edge strip 2. In place of the soft metal, the edge strip 2 can also consist of an elastically deformable plastic material, which is metallized along its exposed surface and is thus protected against UV radiation. The following materials can be considered for the elastically deformable plastic material: polyethylene (PE), polypropylene (PP), polystyrene (PS), polyurethane (PUR), polyester (PES), polyether (PET), or polyvinylchloride (PVC) and their compounds. The selection of the metallizing color can be optional, so that the color of the edge strip 2, which is visible from the outside, can be selected to match the color of the roof tiles.

When installing the roof ridge ventilation element 10, the edge strips 2 can be fitted without problem to the contours of the roof tiles adjacent to the ridge because of their elastic deformability and can be glued to these with the aid of a self-adhesive strip 3. If the roof tiles have an undulating shape, the edge strips 2 can also be embodied with an undulating shape along their outside edges, in a manner not shown herein, in order to have a longer reserve in the longitudinal direction for adapting the edge strips 2 to the shape of these roof tiles.

A reinforcing strip 4 can be attached to the carrier material 1 for reinforcing the carrier material 1 in the longitudinal direction in the center, meaning where the carrier material 1 rests on the ridge pole. Instead of using a reinforcing strip 4, however, is it sufficient in most cases to provide the carrier material 1 with a marking, which indicates its correct positioning during the installation of the roof ridge ventilation element 10, relative to the ridge pole.

According to the invention, each elastically deformable edge strip 2 has an upward pointing fold in a longitudinal direction of the ventilation element 10, which forms an air-repelling lip 21. Each of the lips 21 is located near the location where its edge strip 2 is joined to respective edge region 11 of the carrier material 1. The lip 21 height is dimensioned such that rain water or blowing snow is securely prevented from penetrating the roof tiles in the direction of the air-permeable carrier material 1 and thus also the roof inside space. If the edge strips 2 have an undulating shape, then the lips 21 also have corresponding undulations transverse to their longitudinal extension. these transverse undulations of lips 21 provide a sufficient material reserve to adapt to the resulting differences in length when unrolling the ventilation element 10.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A rollable roof ridge ventilation element for slanted roofs, comprising:

a ribbon-type, air-permeable carrier material, including edge regions; and edge strips of an elastically deformable film connected, respectively, to the edge regions of the carrier material, each edge strip including:

an upward-pointing fold defined by two walls and extending in a longitudinal direction of the ventilation element presenting a wind-repelling lip, wherein each edge strip is comprised of one of (a) a soft metal strip including at least one of aluminum, copper, or lead, or (b) a plastic film including a metallization on an exposed surface, and wherein each edge strip includes transverse undulations, and wherein the wind-repelling lip of each edge strip includes surface undulations in each of the two walls of the fold that extend transverse to the longitudinal direction and correspond to the transverse undulations of the edge strip, whereby the transverse undulations of the wind-repelling lip provide a sufficient material reserve to adapt to differences in length when unrolling the ventilation element.

2. The rollable roof ridge ventilation element according to claim 1, wherein the carrier material includes at least one of a non-woven material, a plastic fabric, a freely perforated plastic film, or a perforated rubber film.

3. The rollable roof ridge ventilation element according to claim 1, and further including:

a self-adhering strip disposed on an underside of each edge strip, the self-adhering strip including a peel-off strip for protection.

4. A rollable roof ridge ventilation element for slanted roofs, comprising:

a strip of air-permeable carrier material defining two longitudinally extending edge regions; and first and second edge strips connected to the edge regions of the carrier material and comprising an elastically deformable material, wherein the elastically deformable material comprises one of (a) a soft metal strip including at least one of aluminum, copper, or lead, or (b) a plastic material metalized on an exposed surface, wherein each edge strip includes undulations that extend transverse to the longitudinal direction, wherein each edge strip includes a longitudinally extending wind-repelling lip defined by a fold having two walls, the walls of the fold including surface undulations that extend transverse to the longitudinal direction and correspond to the transverse undulations of the edge strip so as to provide sufficient material reserve to adapt to differences in length when the ventilation element is unrolled.

* * * * *